US008932413B2

(12) United States Patent
Savard

(10) Patent No.: US 8,932,413 B2
(45) Date of Patent: Jan. 13, 2015

(54) APPARATUS WITH CONTROL LINKAGE FOR RE-SUSPENDING SOLIDS IN FLUID IN A TANK

(75) Inventor: Donald D. Savard, Edmonton (CA)

(73) Assignee: Mixer Technologies Inc., Guelph, Ontario (CA)

( * ) Notice: Subject to any disclaimer, the term of this patent is extended or adjusted under 35 U.S.C. 154(b) by 1023 days.

(21) Appl. No.: 12/999,229

(22) PCT Filed: Jul. 2, 2009

(86) PCT No.: PCT/CA2009/000909

§ 371 (c)(1),
(2), (4) Date: Dec. 15, 2010

(87) PCT Pub. No.: WO2010/000067

PCT Pub. Date: Jan. 7, 2010

(65) Prior Publication Data

US 2011/0088732 A1 Apr. 21, 2011

(30) Foreign Application Priority Data

Jul. 2, 2008 (CA) ..... 2637286

(51) Int. Cl.
*B08B 9/08* (2006.01)
*B08B 9/093* (2006.01)

(52) U.S. Cl.
CPC . *B08B 9/08* (2013.01); *B08B 9/093* (2013.01); *B08B 9/0933* (2013.01)
USPC ..... 134/166 R; 134/167 R

(58) Field of Classification Search
CPC ..... B08B 9/08; B08B 9/093; B08B 9/0933
USPC ..... 134/167 R, 166 R
See application file for complete search history.

(56) References Cited

U.S. PATENT DOCUMENTS

| | | | | |
|---|---|---|---|---|
| 5,392,798 | A | 2/1995 | Hirose et al. | |
| 6,021,793 | A | 2/2000 | Moulder | |
| 6,213,135 | B1 | 4/2001 | Moulder | |
| 7,089,949 | B1 | 8/2006 | Rogerson et al. | |
| 2005/0199269 | A1 * | 9/2005 | Heil et al. | 134/21 |
| 2008/0053484 | A1 * | 3/2008 | Smith | 134/22.1 |

FOREIGN PATENT DOCUMENTS

| | | |
|---|---|---|
| DE | 198 15 579 | 7/1999 |
| EP | 1 531 010 | 5/2005 |
| WO | WO2010/000067 | 1/2010 |

OTHER PUBLICATIONS

Machine Translation of DE19815579 by Bauer (Jul. 22, 1999).*

* cited by examiner

*Primary Examiner* — Michael Barr
*Assistant Examiner* — Spencer Bell

(57) ABSTRACT

An apparatus for cleaning a tank that is to be installed below the fill line of a tank includes a housing sealably attached to a sidewall of a tank, and a tubing having a flexible output end positioned within the housing such that the output end of the tubing extends past the sidewall of the tank. A control linkage is slidably positioned within the housing. The control linkage is connected to the flexible output end of the tubing. The control linkage is movable between an extended position and a retracted position. The orientation of the flexible output end of the tubing is changed as the control linkage is moved between positions, such that the direction of fluid flowing out of the flexible output end of the tubing is also changed. A seal is provided for sealing the tubing and the control linkage within the housing.

7 Claims, 4 Drawing Sheets

APPARATUS WITH CONTROL LINKAGE FOR RE-SUSPENDING SOLIDS IN FLUID IN A TANK

RELATED APPLICATION DATA

This application is the national stage entry of International Patent Application No. PCT/CA2009/00909, filed on Jul. 2, 2009, and claims priority therefrom.

FIELD

An apparatus for cleaning the inside of a tank.

BACKGROUND

In many storage tanks used in various fields, sediment often collects on the bottom of the tank. To ensure that tank volumes are not lost to this sediment accumulation, or if the tank needs to be cleaned for other reasons such as required inspections, change or storage service, the sediment must be removed. It can be removed manually or by remote re-suspension, which often involves fluid pressure directed into the tank.

SUMMARY

There is provided an apparatus for cleaning a tank that is to be installed below the fill line of a tank. The apparatus comprises a housing sealably attached to a sidewall of a tank, and a tubing having a flexible output end positioned within the housing such that the output end of the tubing extends past the sidewall of the tank. A control linkage is slidably positioned within the housing. The control linkage is connected to the flexible output end of the tubing and extending outside the tank. The control linkage is movable between an extended position and a retracted position. The orientation of the flexible output end of the tubing is changed as the control linkage is moved between positions, such that the direction of fluid flowing out of the flexible output end of the tubing is also changed. A seal is provided for sealing the tubing and the control linkage within the housing. The seal permits sliding movement of the control linkage through the seal.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
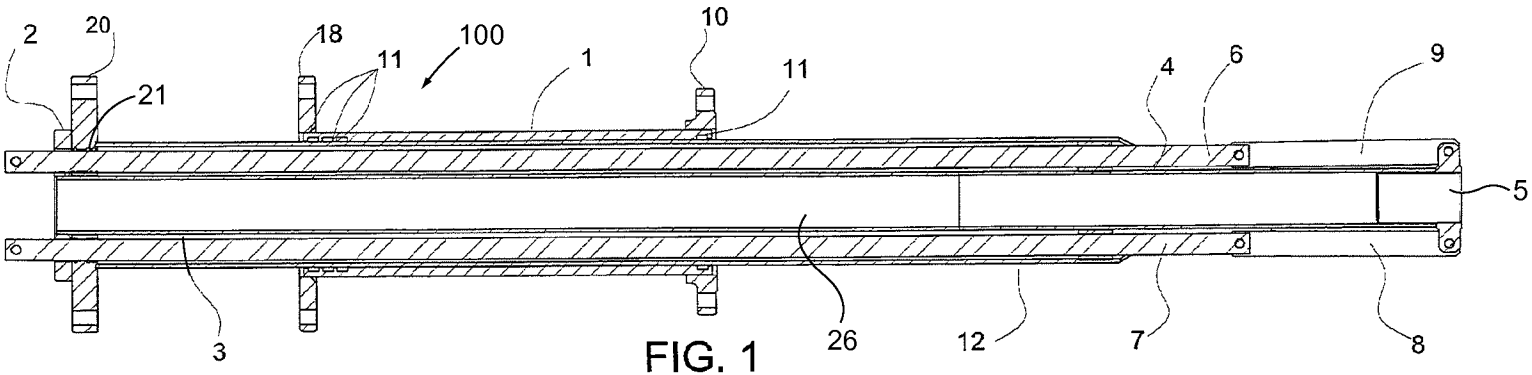
FIG. 1 is a top plan sectional view of an apparatus for cleaning a tank.

An apparatus for cleaning a tank, generally identified by reference numeral 100, will now be described with reference to FIG. 1 through 6.

Figure 5:
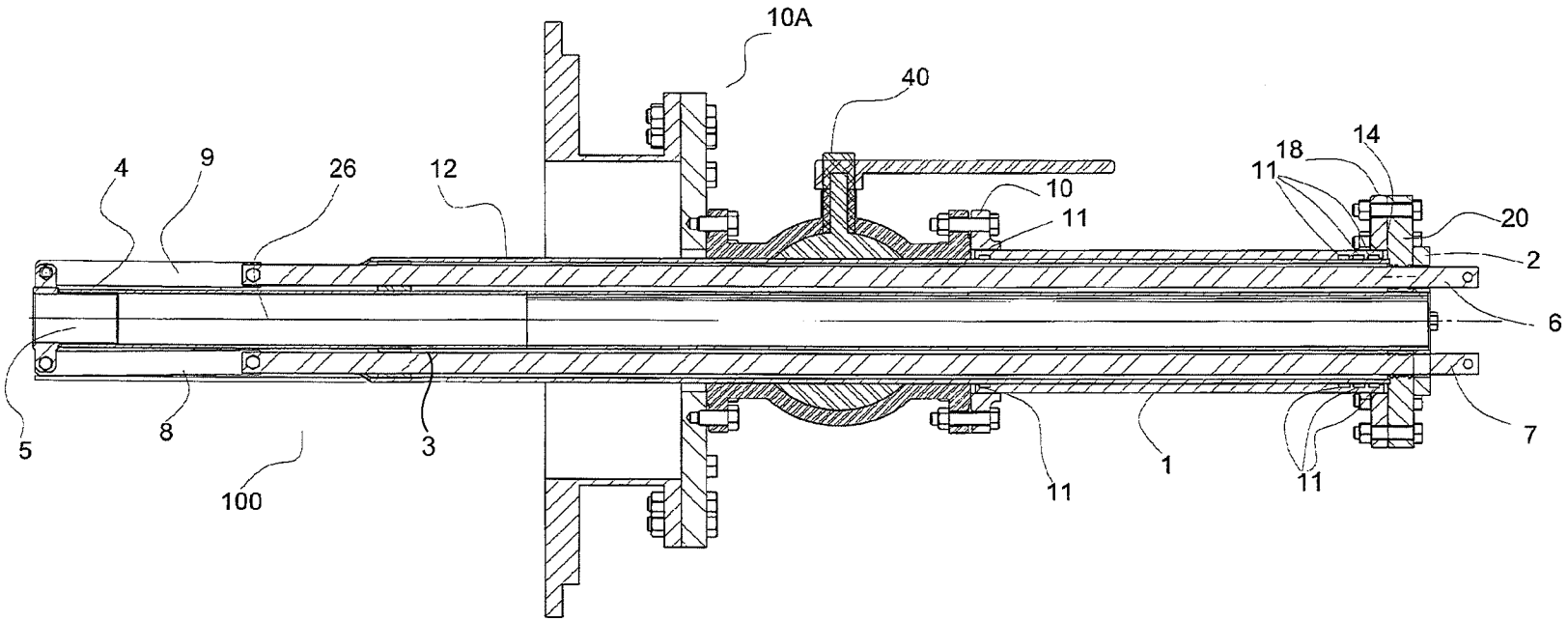
FIG. 5 is a top plan sectional view of the apparatus of FIG. 1 installed in the flange of a tank.

Structure and Relationship of Parts:

Referring to FIG. 1, apparatus 100 can be used as a permanent device installed on the tank, or as a temporary unit for tank cleaning. Referring to FIG. 5, apparatus 100 can be installed through a small opening in the tank using a stuffing box 1 so that the tank does not have to be taken out of service, or once the tank is out of service, the apparatus can be installed in an existing opening.

Referring to FIG. 1, apparatus 100 consists of a flow inlet flange 2 where fluid is pumped into the tank. Tubing with a flexible output end, such as a flow pipe 3 with a hose 4 attached to the end of flow pipe 3, is welded or otherwise attached and sealed to inlet flange 2. Fluid flows through the interior 26 of flowpipe 3, and exits into the interior of a tank through a nozzle 5. Flow pipe 3 is positioned within a housing pipe 12 that is sealed to the tank by a stuffing box 1. Control linkages made up of control rods 6 and 7 and connector rods 8 and 9, are used to control the position and orientation of nozzle 5, and thus control the direction of fluid flow into the tank. Control linkages must also be sealed within a housing pipe 12. As shown, this is done by extending rods 6 and 7 through a flange 20, and providing O-ring seals 21 about the rods 6 and 7. In addition, while two control linkages are provided, it will be understood that apparatus 100 may also operate with a single linkage. However it has been found that more favourable results may be obtained by using two.

Figure 2:
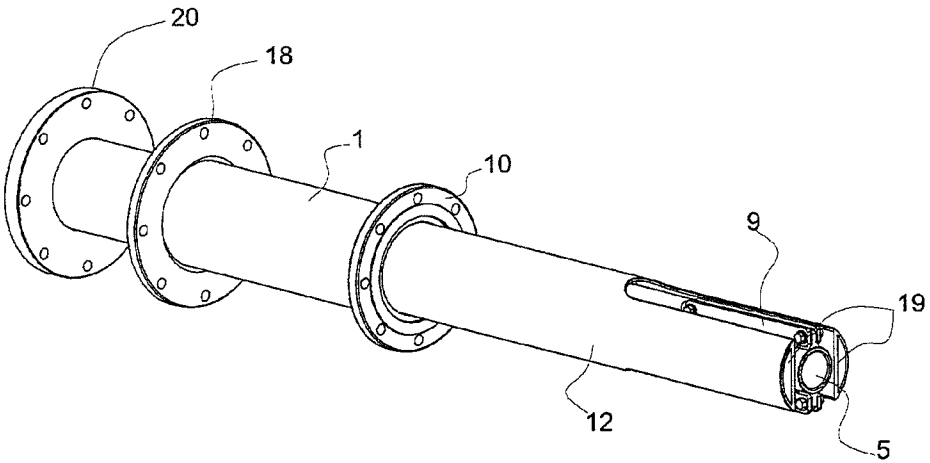
FIG. 2 is a perspective view of the apparatus of FIG. 1.
Figure 3:
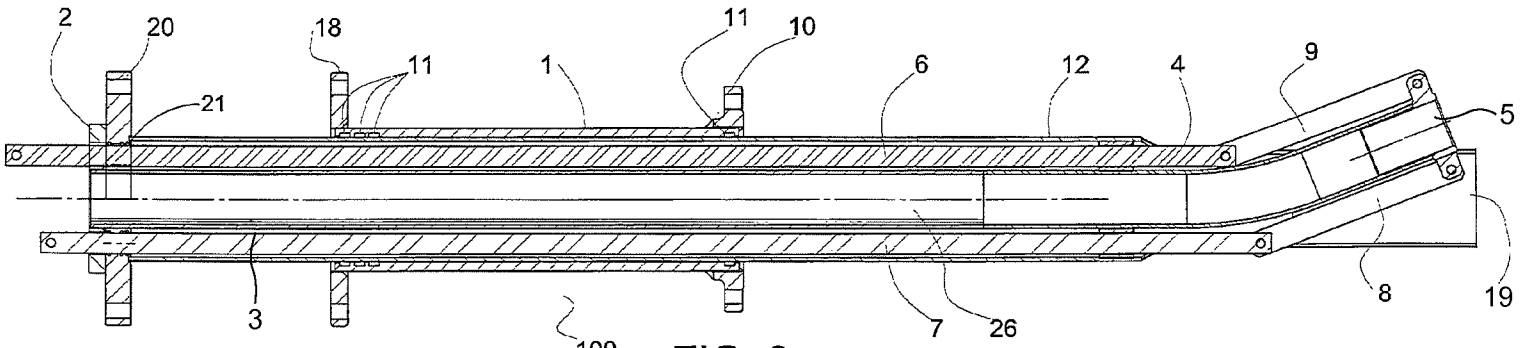
FIG. 3 is a top plan sectional view of the apparatus of FIG. 1 oriented to a first side.
Figure 4:
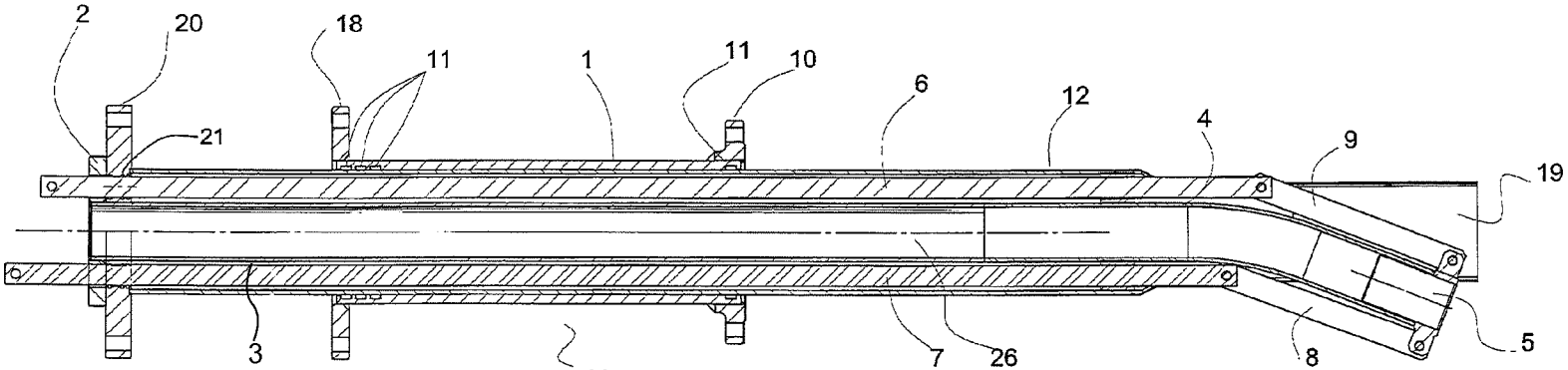
FIG. 4 is a top plan sectional view of the apparatus of FIG. 1 oriented to a second side.
Figure 6:
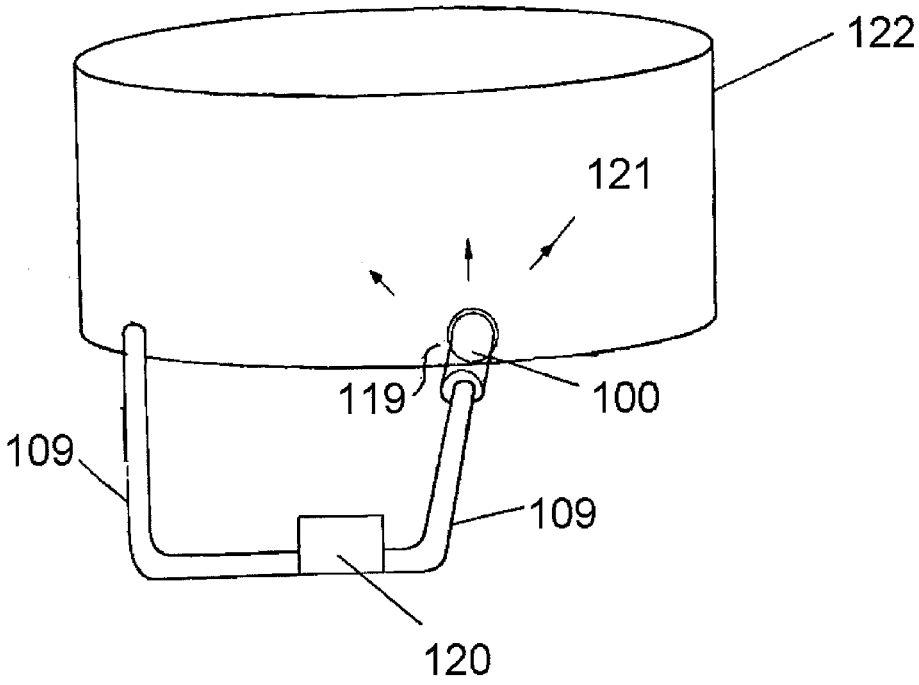
FIG. 6 is a perspective view of the apparatus of FIG. 1 installed on a tank.

Referring to FIG. 2, guide bars 19 are used to guide the nozzle 5 in and out of the housing pipe 12 as it rotates through the various orientations. Referring to FIGS. 3 and 4, by pushing or pulling control rods 6 or 7 which are connected to connector rods 8 and 9 on each side of the nozzle 5 between an extended and a retracted position, the orientation of the nozzle 5 can be moved in an arc. The pipe assemblies 3, hose 4 and nozzle 5 are constructed to ensure that fluid is discharged with minimal disruption to flow. Referring to FIG. 5, the stuffing box 1 is attached to the tank by bolting flange 10 to the tank flange 10A or valve 40. Seals 11 between apparatus stuffing box 1 and housing pipe 12 are used to keep fluid from leaking from the tank. The pipe 12 is fixed to allow nozzle 5 to move horizontally allowing the flow from nozzle 5 to reach all areas of the tanks bottom. Other orientations may also be used, depending on the preferences of the user. Flange 18 and 20 are used to keep the apparatus from being forced into or out of the tank. An expandable plug (not shown) is installed in the flow pipe 3 when the system is not in use and is removed using a special tool that prevents the escape of fluid when the apparatus system is to be used. When not in use, a cover (not shown) can be placed over the complete system to ensure that the tank is fully secured. Referring to FIG. 6, the complete re-suspension is shown. Piping 109 is connected to tank 122 and pump 120. Piping 109 is hooked to apparatus 100 at flange 119 on tank 122. Fluid is then pumped through apparatus 100 and directed to all quadrants 121 of the tank ensuring that all areas of the tank are cleaned.

Advantages:

The apparatus will be especially useful where there is limited access to the interior of the tank. The use of controlled high velocity fluid is a proven technology to re-suspend the sediment that has settled. The design of the apparatus ensures that re-suspension fluid velocity is controlled and not compromised during the operation of the unit. The apparatus is designed so that unimpeded fluid flows are available when required, but also to allow fluid to reach all section of a tank's bottom with sufficient flow to re-suspend material adhered to these surfaces. The unit is especially efficient when used in crude oil storage tanks where sediment from the production of crude oil is deposited in the bottom of the storage tanks used for crude oil production. The design of the unit allows for the installation in a very small opening, although the apparatus can also be installed in large openings if required. The unit can be removable, or may remain permanently installed on the tank to facilitate cleaning at a later date or on those tanks that need regular cleaning.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

I claim:

1. An apparatus for re-suspending solids in fluid in an interior of a tank, the solids having accumulated on a bottom wall of the tank, the apparatus comprising:

a housing pipe sealably attached to a sidewall of the tank at an opening therein located proximal to the bottom wall and extending inwardly into the interior of the tank, the housing pipe comprising two slots on diametrically opposite sides thereof extending a predetermined distance from an inner end of the housing pipe toward the sidewall;

tubing at least partially positioned within the housing pipe and extending between an input end proximal to the sidewall and an output end at the inner end of the housing pipe, the tubing comprising a flexible hose and a nozzle attached to the flexible hose, the nozzle being positionable at the inner end of the housing pipe and coaxial therewith;

a pump for pumping the fluid through the tubing to exit therefrom through the flexible hose at the nozzle;

first and second control linkages, each said control linkage comprising a control rod extending between an outside end thereof located outside the sidewall and an inside end in the housing pipe, and a connector rod extending between a first end thereof pivotably connected to the inside end of the control rod of the control linkage thereof and a second end thereof attached to the nozzle;

the first and second control linkages being positioned at least partially within the housing pipe and movable relative to the housing pipe, the connector rods of the first and second control linkages being attached to diametrically opposite sides of the nozzle and each of the first and second control linkages being positioned adjacent to corresponding diametrically opposite sides of the tubing, the connector rods being aligned with the slots in the housing pipe;

each said control linkage being movable between a straight position, in which the hose is located substantially parallel to the housing pipe and the nozzle is located substantially coaxially with the housing pipe, and a bent position, in which the hose is at least partially located non-parallel to the housing pipe, to position the nozzle non-coaxially relative to the housing pipe and at least partially in one of the slots in the housing pipe, wherein the direction of the fluid flowing out of the nozzle is controllable via the control rods, for re-suspending the solids in the fluid in the tank; and at least one seal for providing a seal between the tubing and the respective control rods of the first and second control linkages with the housing pipe, said at least one seal permitting sliding movement of the respective control rods of the first and second control linkages through said at least one seal.

2. The apparatus of claim 1, further comprising a stuffing box for sealably attaching the housing pipe to the sidewall of the tank.

3. The apparatus of claim 1, wherein the tubing comprises a rigid portion extending from the flexible output end outwardly past the sidewall of the tank.

4. The apparatus of claim 1, wherein the tubing comprises a valve, the valve being configured to prevent the fluid in the tank from escaping outwardly through the tubing.

5. The apparatus according to claim 1 additionally comprising at least one guide bar to guide the nozzle in and out of the slots in the housing pipe as the control linkages are moved between the respective bent and the straight positions thereof.

6. An apparatus for re-suspending solids in fluid in an interior of a tank, the apparatus comprising:

a housing pipe sealably attached to a sidewall of the tank at an opening therein and extending inwardly into the interior of the tank, the housing pipe comprising two slots positioned diametrically opposite to each other extending from an inner end of the housing pipe toward the sidewall;

tubing at least partially positioned within the housing pipe, the tubing comprising a flexible output end with a nozzle therein positionable at the inner end of the housing pipe;

a pump for pumping the fluid through the tubing to exit therefrom through the flexible output end at the nozzle;

two control linkages slidably positioned at least partially within the housing pipe, the control linkages being connected to diametrically opposite sides of the nozzle respectively and extending outside the tank, each of the control linkages being selectively movable between an extended position, in which the flexible output end is held substantially parallel to the housing pipe and the nozzle is substantially coaxial with the housing pipe, and a retracted position, in which the flexible output end is located substantially non-parallel with the housing pipe and partially in a selected one of the slots, to locate the nozzle non-coaxially with the housing pipe and at least partially in the selected one of the slots, thereby changing the direction of the fluid flowing out of the nozzle for re-suspending the solids in the fluid in the tank; and at least one seal for sealing the tubing and the control linkages within the housing pipe, said at least one seal permitting sliding movement of the control linkages therethrough.

7. An apparatus according to claim 6 additionally comprising guide bars to guide the nozzle and the flexible output end of the tubing in and out of the respective slots as the control linkages are moved between the extended and the retracted positions respectively.

* * * * *